United States Patent [19]

Aragon

[11] 4,226,070

[45] Oct. 7, 1980

[54] SYNTHETIC SPANISH OR MISSION TILE ROOFING SYSTEM

[76] Inventor: Robert C. Aragon, 6405 Ester NE, Albuquerque, N. Mex. 87109

[21] Appl. No.: 34,854

[22] Filed: Apr. 30, 1979

[51] Int. Cl.[3] ..... E04B 7/00; E04D 1/30; E04D 3/40

[52] U.S. Cl. ..... 52/57; 52/94; 52/314; 52/519

[58] Field of Search ..... 52/57, 58, 90, 94, 278, 52/311, 314, 554, 555, 556, 518, 43, 519, 309.1

[56] References Cited

U.S. PATENT DOCUMENTS

| | | | |
|---|---|---|---|
| 2,664,177 | 12/1953 | Hammitt et al. | 52/58 |
| 3,461,628 | 8/1969 | Wienand et al. | 52/309.1 |
| 3,485,002 | 12/1969 | Baker | 52/314 |
| 3,621,625 | 11/1971 | Medow | 52/314 |
| 4,015,391 | 4/1977 | Epstein et al. | 52/57 X |
| 4,024,685 | 5/1977 | Aarons | 52/57 X |

FOREIGN PATENT DOCUMENTS

| | | | |
|---|---|---|---|
| 1949035 | 4/1971 | Fed. Rep. of Germany | 52/57 |
| 2017537 | 10/1971 | Fed. Rep. of Germany | 52/57 |
| 2259920 | 6/1974 | Fed. Rep. of Germany | 52/57 |

*Primary Examiner*—J. Karl Bell
*Attorney, Agent, or Firm*—Walter R. Keller

[57] ABSTRACT

A roofing system having the appearance of Spanish or Mission tile made of fiberglass, with an interlocking overlapping means, which may be secured by conventional means such as nails or adhesives to new roofing structure or over existing roofing.

1 Claim, 5 Drawing Figures

SYNTHETIC SPANISH OR MISSION TILE ROOFING SYSTEM

BACKGROUND OF THE INVENTION

1. Field of the Invention

The present invention generally pertains to the field of building construction and building remodeling, and more particularly to the field of roofing for residential and commercial buildings.

2. Description of the Prior Art

The use of Spanish or Mission tile as a roofing material is very common in many geographical areas. The Spanish or Mission tile is made of ceramic material and has certain properties such as shedding water, weather resistance, strength and durability which are very desirable. The tiles being arcuate in cross section are laid side by side along the outer edge of the roof forming a first course of tiles, and a second course of tiles is laid with the lower ends of the second course overlapping the upper ends of the first course. The color, shape, and pattern of the tiles as laid creates a unique asthetic quality which is desireable to be maintained. However, the Spanish or Mission tile is very heavy and very brittle. The ordinary tile weighs approximately nine pounds per square foot and requires an especially strong roof to support the weight of the tile. In addition, because of the extreme brittleness of the ceramic tile, waste in manufacturing runs as high as twenty percent and loss due to breakage in shipment and installation has been found to run approximately twelve percent. Thus the cost to install ceramic tile, including shipping, labor, waste, and loss is high.

In order to provide an economical imitation roofing yet retaining the asthetic appearance of Spanish tile, BAKER, U.S. Pat. No. 3,485,002 invented an imitation Spanish tile produced from thin sheets of normally hard or stiff or rigid thermoplastic or thermosetting plastic material. BAKER provided a substantially water proof and weather resistant imitation roofing material primarily for decorative purposes; but BAKER did not intend nor provide a product intended for ordinary roofing, nor is it suitable product for ordinary roofing because it lacks sufficient strength. WIENAND, U.S. Pat. No. 3,461,628 taught a square plate-shaped roof shingle made of thermoplastic material such as polyvinyl chloride, poly vinylidene chloride, polyurethanes, polyethylene, poly propolene, etc. However, WIENAND emphasizes shingle interlocking means which is not adaptable to the arcuate shape of Spanish tile. MEDOW, U.S. Pat. No. 3,621,625 teaches a simulated brick siding made of synthetic resinous materials impregnated with glass fibers for strength and rigidity. MEDOW primarily teaches how to interlock sheets so that half-bricks at the edge of the sheet mate to appear as whole bricks. The interlocking means taught by MEDOW is not appropriate for roofing materials, since ther interlocking means of MEDOW could permit rain water to be blown between sheets if installed on a roof. In addition, MEDOW does not teach how to cap or otherwise cover a roof ridge or apex.

DESCRIPTION OF THE PREFERRED EMBODIMENT

Figure 1:
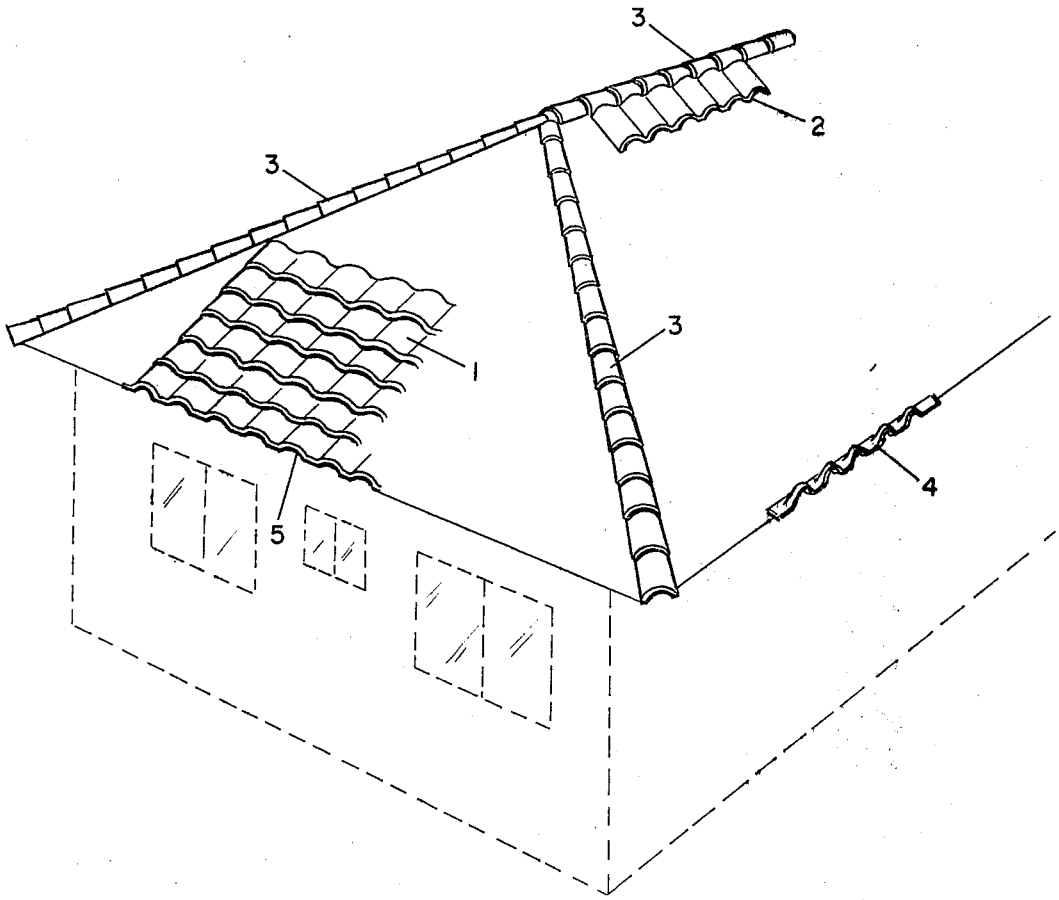
FIG. 1 is an isometric view of a house having the separate parts of the invention depicted.
Figure 2:
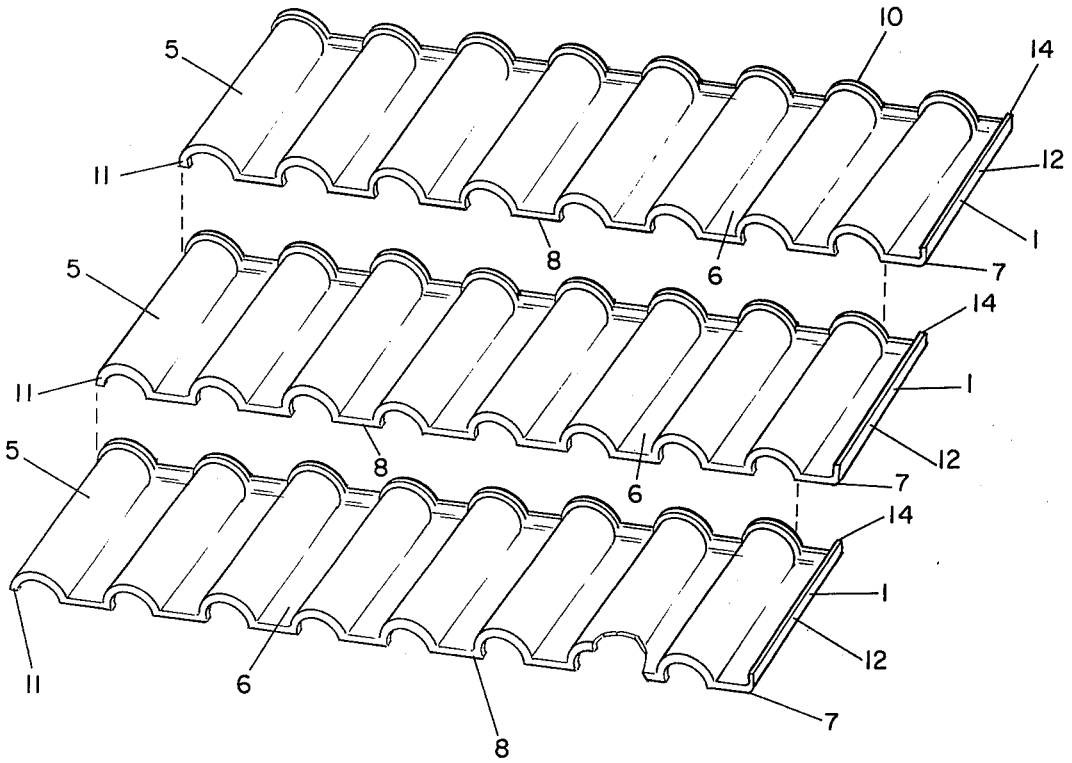
FIG. 2 is an isometric view of a panel of tile.

Referring to the drawings, FIG. 1 shows the basic elements of the invention described herein as applied to a typical roof of a residence; the basic elements are shown as a panel of tile (1), a ridge row cap (2), a hip cap (3); and a bird stop (4). FIG. 2 shows the details of a panel of tile (1) is shown to have a plurality of elongated arcuate sections (5) of approximately the same dimensions of usual clay Spanish tile connected by and integrally formed with flat sections (6). The panel of tile (1) is shown to have a lower edge (7) an upper edge (9). Shown in FIG. 2 are three full courses of simulated tiles units. It is obvious that the number of arcuate section (5) in each course could vary as a choice of production and design. At the lower edge 7, each panel of tile 1 has a downward lip 8 formed to simulate the beginning of an overlapping of the usual clay tile. The upper edge (9) has an upward protruding lip (10) which hooks under the overlapping downward lip (8) of the next higher course. The panel of tile (1) is shown to have an arcuate end (11) and lip end (12). When panels of tile overlap on ends, an arcuate end (11) overlaps the lip end (12). Lip end (12) has an end lip (14) protruding upward to provide a water and air barrier at the junction of overlapping ends.

Figure 3:
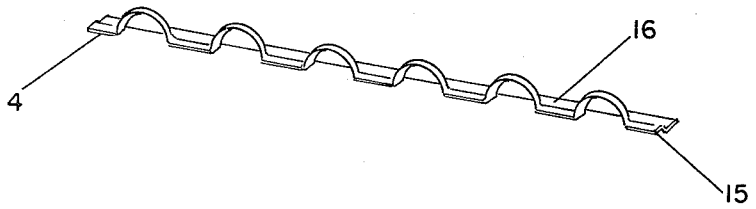
FIG. 3 is an isometric view of a bird stop.
Figure 4:
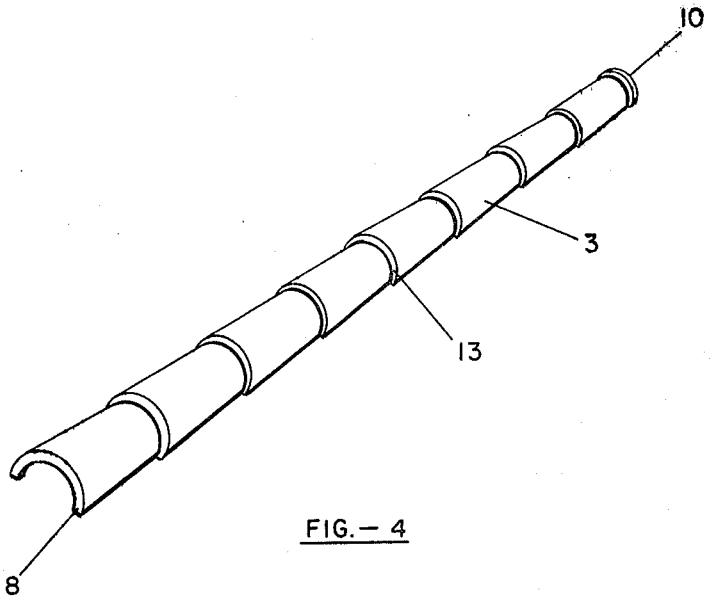
FIG. 4 is an isometric view of a hip caps.
Figure 5:
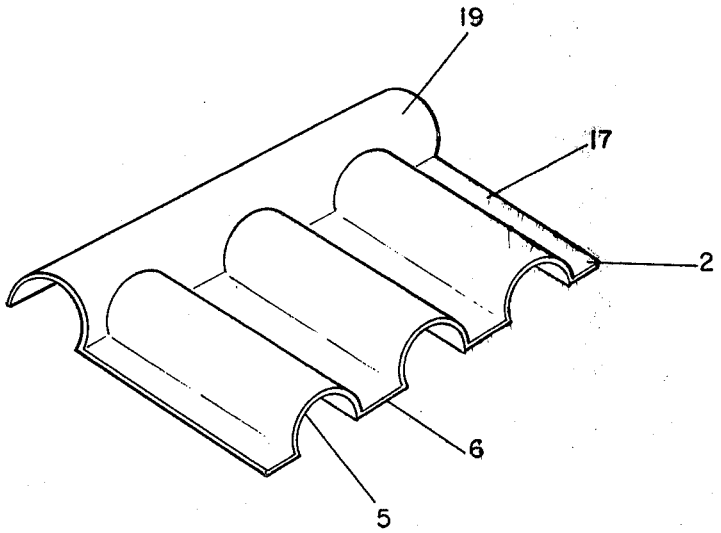
FIG. 5 is an isometric view of a ridge cap.

As shown in FIG. 1, at the lower course as applied to the roof, the arcuate section (5) of a panel of tile leave openings which must be closed to prevent nesting of birds and insects. This is accomplished by installing a bird stop (4). As shown in FIG. 3, the bird stop (4) is basically shaped to mate with the panels of tile (1) so that the openings created by the arcuate sections (5) are closed. The bird stops (4) has a hooking lip (15) the whole length of the bird stop (4) which hooks under the panel of tile (1) so that the hooking lip (15) of the bird stop (4) is overlapped by the downward lip 8 of the panel of tile 1, and an attaching lip (16) for attaching to the sub-roof of the house. Where two planes of the roof intersect the roof forms a hip, and a hip cap (3) is provided to cover the line of intersection. As shown in FIG. 1, the hip cap (3) simulates a single row of tiles end to end. The hip cap (3) has false lips (13) and a downward lip (8) on one end which simulates the usual tile. The hip cap (3) has an upward protruding lip (10) which hooks under the downward lip (8) of the overlapping hip cap 3.

In the installation of tile at either a ridge row or a hip of a house it is usual and customary to generously apply concrete at the apex and implant therein a row of tile. The invention as shown in FIG. 1 utilizes a ridge row cap (2). The ridge row cap (2) comprises two mating sections (17) which are identical. Each section (17) is formed to have arcuate section (5) and flat sections (6) which overlap and mate with the arcuate sections (5) and flat sections (6) of the panels of tile 1. However, each section (17) of the ridge row cap (2) has a partial cylindrical section (19) normal to the arcuate section (5) of the ridge row (2). The curvature of the partial cylindrical section (19) is sufficiently large to accomodate a variety of slopes in the intersection plans of the roof. The two mating sections (17) of the ridge row cap (2) overlap along the ridge row, and are fastened to the roof. Along the top of the ridge row cap (2) and over it is placed the hip cap (3) in the usual manner thus providing without the extraordinary expense and weight of concrete being generously applied to the ridge row, a water tight barrier.

Since all sections and parts of the system are made of fiberglass it is necessary to drill nail holes at convenient locations to permit attaching to the frame of the roof.

Having thus described the physical shape of the components, it is necessary to discribe the process of fabrication.

All parts are made of fiberglass. Molds made of steel or other material of sufficient strength to withstand repeated spraying and curing, are sprayed with slurry of resins and string glass fibers until the desired thickness is achieved. Any thermosetting resin may be used including polyester, epoxy, silicone, etc., which when slurried with string of glass fibers may be sprayed. The finished product should have a thickness of approximately one-eighth to three-sixteenths of an inch in order to insure sufficient strength. An alternative process called the roving process is to spray the resin on the mold and to roll the glass fibers into the resin before it cures. To give the color and appearance of Spanish or Mission tile, the parts can be fabricated with the color pigment in the slurry, or painted after curing.

I claim:

1. A synthetic spanish tile roofing system said system comprising:

a panel having one or more rows having alternate arcuate sections and flat sections and on its lower edge of said panel, its entire length, having a lip protruding downward and on its upper edge, its entire length having a lip protruding upward, and the panels ending on one end with an arcuate section and on the other end a flat section and the end of said panel, having a flat section, having a lip upward the entire length of the end, and the alternate arcuate and flat sections of the panel being dimensioned similar to Spanish tile; and a bird stop having a mounting lip its entire length on its bottom edge, and the top edge having an alternate arcuate sections and flat sections configuration to mate with the alternate arcuate sections and flat sections of the said panel, and the bird stop having a protruding lip along the entire upper edge which engages the downward protruding lip of a lowest panel installed on a roof, and a hip cap section having an arcuate crossection and a plurality of false lips appearing as the ends of tile and the lower end having a lip protruding downward and the upper end having a lip protruding upward so that the lower end of one hip cap section overlaps the upper end of the adjoining hip cap section, and a ridge row cap having a plurality of alternating arcuate sections and flat sections, dimensioned to mateably fit the alternating arcuate sections and flat sections of the aforesaid panel, and having an arcuate section whose axis is normal to the arcuate and flat sections of the ridge row cap, said ridge row cap being used in pairs so that the arcuate sections normal to the arcuate and flat sections of the ridge row cap overlap at the ridge row; and said panel, bird stop, ridgerow cap and hip cap are made of fiberglass material of sufficient strength and thickness for roofing material, and being impregnated with pigment or painted to appear as Spanish tile.

* * * * *